US008747145B2

(12) United States Patent
Gossen et al.

(10) Patent No.: US 8,747,145 B2
(45) Date of Patent: Jun. 10, 2014

(54) ELECTRICAL CONNECTOR

(75) Inventors: Konstantin Gossen, Lautertal (DE); Tobias Schmoeker, Bensheim (DE); Michael Zayc, Lampertheim (DE); Franz-Josef Thiel, Worms (DE); Stefan Ernst Glaser, Heppenheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/255,622

(22) PCT Filed: Mar. 8, 2010

(86) PCT No.: PCT/EP2010/052911

§ 371 (c)(1),
(2), (4) Date: Sep. 9, 2011

(87) PCT Pub. No.: WO2010/102978

PCT Pub. Date: Sep. 16, 2010

(65) Prior Publication Data

US 2012/0003860 A1 Jan. 5, 2012

(30) Foreign Application Priority Data

Mar. 12, 2009 (EP) ..... 09155011

(51) Int. Cl.
*H01R 13/58* (2006.01)

(52) U.S. Cl.
USPC ..... 439/460

(58) Field of Classification Search
USPC ..... 439/460, 466, 942, 271, 272, 274, 275, 439/279, 470–472, 449, 459, 455, 463, 395, 439/527, 587, 595, 456, 469; 174/153 G
See application file for complete search history.

(56) References Cited

U.S. PATENT DOCUMENTS

| | | | | | |
|---|---|---|---|---|---|
| 4,684,190 | A | * | 8/1987 | Clark et al. | 439/587 |
| 4,832,616 | A | | 5/1989 | Stein, Sr. et al. | |
| 4,871,323 | A | * | 10/1989 | Ohsumi | 439/188 |
| 5,021,610 | A | | 6/1991 | Roberts | |
| 5,244,407 | A | | 9/1993 | Volk et al. | |
| 5,613,868 | A | * | 3/1997 | Ohsumi et al. | 439/275 |
| 5,700,156 | A | * | 12/1997 | Bussard et al. | 439/471 |
| 6,077,122 | A | * | 6/2000 | Elkhatib et al. | 439/607.05 |

(Continued)

FOREIGN PATENT DOCUMENTS

| | | | |
|---|---|---|---|
| DE | 4015793 | A1 | 12/1990 |
| DE | 4206568 | A1 | 9/1992 |

(Continued)

OTHER PUBLICATIONS

Search Report issued by the European Patent Office, dated Jul. 31, 2009, for Priority Application No. EP 09155011.1, 6 pages.

(Continued)

*Primary Examiner* — Renee Luebke
*Assistant Examiner* — Harshad Patel
(74) *Attorney, Agent, or Firm* — Faegre Baker Daniels LLP

(57) ABSTRACT

The invention relates to a connector with a housing, with terminals, with conductors that are connected with the terminals, with a guidance element that is arranged in the housing and that guides the conductors in the housing, with an elastic element that is arranged between the conductors and the guidance element, with a retainer element that forces the conductors against the elastic element.

18 Claims, 7 Drawing Sheets

(56) References Cited

U.S. PATENT DOCUMENTS

| | | | | |
|---|---|---|---|---|
| 6,398,585 | B1 * | 6/2002 | Fukuda | 439/587 |
| 6,443,765 | B2 * | 9/2002 | Ichio et al. | 439/587 |
| 6,494,740 | B1 * | 12/2002 | Fukuda et al. | 439/587 |
| 6,514,102 | B1 * | 2/2003 | Fukuda et al. | 439/587 |
| 7,070,454 | B1 * | 7/2006 | Pepe et al. | 439/638 |
| 7,126,064 | B1 * | 10/2006 | Shemtov | 174/662 |
| 2009/0011637 | A1 * | 1/2009 | Kim, II | 439/578 |

FOREIGN PATENT DOCUMENTS

| | | | |
|---|---|---|---|
| DE | 202005019209 | U1 | 6/2006 |
| DE | 102007028836 | A1 | 12/2008 |
| EP | 0652607 | A2 | 5/1995 |
| FR | 2779012 | A1 | 11/1999 |
| GB | 402563 | | 12/1933 |

OTHER PUBLICATIONS

International Preliminary Report on Patentability issued the The International Bureau of WIPO, Geneva, Switzerland, dated Sep. 13, 2011 for International Application No. PCT/EP2010/052911; 5 pages.

* cited by examiner

ELECTRICAL CONNECTOR

BACKGROUND

The invention generally refers to a connector with a housing, with terminals, with conductors that are connected with the terminals, with a guidance element for the conductors.

In the state of the art, there are several types of connectors known. U.S. Pat. No. 5,244,407 discloses a multi-piece connector backshell assembly with internal supports. A connector backshell assembly for wires or crackshell cables is provided in which a body and a cover define a housing therefore. An internal support member is mounted within the housing in the form of a split support which secures the wires or cables therebetween. A connector is mounted to the housing at the forward end thereof, whereby the connector electrically engages wires or crackshell cables. An exit clamp member mounted to such a body proximate the aft end thereof, which defines a wide-exit window, is provided for further securing such wires or crackshell cables as they exit the housing to thus provide double conductive member support and strain relieve where such conductive members engage the connector, for example when the conductive member or members are bent or twisted relative to the connector backshell assembly.

The U.S. Pat. No. 4,832,616 discloses an electrical connector with a conductor seal lock. The electrical connector comprises a connector body having a plurality of longitudinal cavities which include rearward sealing portions, terminals disposed in the cavities and attached to conductors which extend out of the rearward sealing portions of the cavities and elastomeric seal sleeves for sealing the conductor and the electric connector. A conductor seal lock attached to the conductor end of the connector body has towers coaxially disposed on the conductors and actually compressing the elastomeric seal sleeve to ensure full insertion of the terminals and the accurate position of the terminals in the cavities.

The German patent application DE 4015793 A1 discloses a connector with a double sealing arrangement against dust and water, whereby the connector comprises two sealing sleeve parts that are arranged at least at two connector terminals to seal the terminals. The connectors additionally comprise a sealing cover arranged at a cable fixing that fastens the cables that are connected with the terminals to seal the cables twofold.

SUMMARY

The object of the invention is to provide an improved connector with an improved fastening of the conductors.

The object of the invention is attained by the connector as disclosed in claim 1. One advantage of the connector is to provide an improved fastening of the conductor that results in transmitting less movement and forces to terminals that are connected with the conductors.

A further advantage of the invention is to provide a simple structure of the connector with an improved guiding of the conductors. The objects of the invention are attained by providing an elastic element between the conductors and the guidance element. The guidance elements provide the guidance function and the elastic element provides the elastic fastening of the conductors. The elastic fastening of the conductors results in an improved protection of the terminals against forces that work on the conductors.

Further advantages of embodiments of the invention are disclosed in the dependent claims.

An embodiment of the invention refers to a separate flexible element. The elastic element is embodied as a separate element and can therefore be made of a different material than the guidance element.

A simple embodiment of the elastic element is attained by using an elastic o-ring as an elastic element. The elastic o-ring is cheap and can easily be positioned in the housing.

In a further embodiment, the elastic element may be part of the guidance element. This provides the advantage that the position of the elastic element referring to the guidance element is precisely defined and less parts have to be handled during the mounting of the connector.

In a further embodiment, the guidance element comprises recesses in which the conductors are disposed and by which the conductors are guided according to a predefined direction. Because of the guiding in the predefined direction, the fastening of the conductors is improved. That results in combination with the flexible element in transferring less forces to the terminals.

In a further embodiment, the guidance element comprises two rows of recesses at opposite sides, whereby at the opposite sides rows of conductors are arranged that are guided in the recesses. This provides a guidance element for a lot of conductors that have to be guided in a small space.

In a further embodiment, the o-ring is arranged at one side of the guidance element, whereby at least one conductor is in contact with two sections of the o-ring. Therefore, the conductor is in contact with two sections of the o-ring which improves the elastic fastening of the conductor.

In a further embodiment, the guidance element comprises two protruding parts at which the o-ring is fixed. This provides a simple and reliable fixing of the o-ring with the guidance element.

In a further embodiment, there are sealing means arranged between the conductors and the connector housing to seal the connectors against dust or water. This improves the sealing of the connector.

In a further embodiment, the retainer element comprises two arms that circumvent at two sides the guidance element. Thus, it is possible to hold two series of conductors at opposite sides of the guidance element with the retainer element. Furthermore, the two arms provide a strong and reliable fixing of the retainer element with the housing.

In a further embodiment, the retainer element comprises only one arm that is arranged on one side of the guidance element and that presses one row of conductors to the elastic element. This structure of the retainer element is simple and useful if there is only one series of conductors at one side of the guidance element.

In a further embodiment, there are second sealing means that are arranged at the conductors, whereby the second sealing means closes free space between the housing and the conductors to prevent infiltration of fluid into the connector. The second sealing means improve the sealing of the connector.

BRIEF DESCRIPTION OF THE DRAWINGS

In a further embodiment, snapping means are provided for fastening the retainer element to the housing.

Embodiments of the connector are described referring to the following figures, whereby

FIG. 1 discloses a connector 1 with a housing 2, with several terminals 3 that are connected with conductors 6. The terminals 3 are arranged in terminal chambers 8 of the housing 2 and that are disposed for being connected with further terminals. The terminal chambers 8 are open to a front side 50 of the connector 1 for introducing further terminals. For example for each terminal 3 one terminal chamber 8 may be provided. The housing 2 comprises at a rear end 9 an opening 11 through which the conductors 6 are guided. In the shown embodiment, there are two rows of conductors 6, whereby each row comprises three conductors 6. The conductors 6 are guided by a guidance element 4, whereby for each conductor 6 two guiding recesses 17 are provided. FIG. 1 shows the guidance element 4 in a position at which the guidance element 4 is pushed through the opening 11 of the rear end in the housing 2. The opening 11 of the rear end 9 of the housing 2 comprises an oval cross-section in which the guidance element 4 is inserted. At two opposite sides, the rear end 9 comprises first recesses 12, in which disposed latches 13 of the guidance element 4 are inserted.

Figure 1:
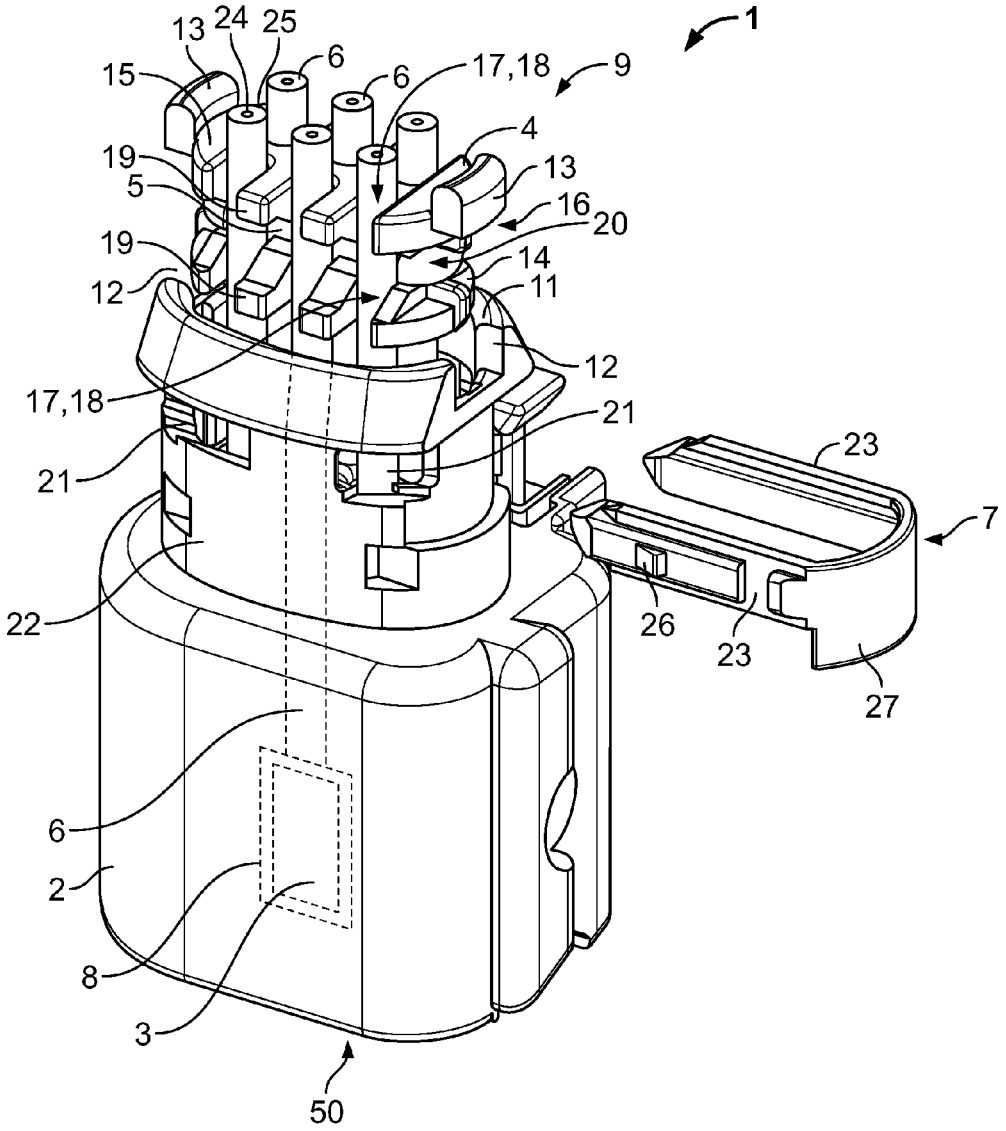
FIG. 1 shows a perspective view of a connector.

The guidance element 4 comprises a lower plate 14 and an upper plate 15 that are connected by a connecting part that is not shown in FIG. 1, whereby between the lower plate 14 and the upper plate 15 a circular groove 16 is arranged. The lower plate 14 and the upper plate 15 are of the same size and are arranged in parallel above each other. The lower plate 14 and the upper plate 15 comprise guiding recesses 17, whereby a guiding recess 17 of the lower plate 14 is arranged below a guiding recess 17 of the upper plate 15. The guiding recesses 17 of the lower plate 14 and of the upper plate 15 define guidance channels 18 for the conductors 6. Each of the conductors 6 is guided through a guiding recess 17 of the lower plate 14 and through a guiding recess 17 of the upper plate 15 along a guidance channel 18. An elastic element 5 is arranged in the groove 16 surrounding the connecting part. The elastic element 5 may be embodied as one-piece with the guidance element 4. In a further embodiment, the elastic element 5 is constructed as an o-ring, whereby the o-ring is arranged between the conductors 6 and the guidance element 4. Therefore, the conductors 6 lie against the o-ring 5.

In the shown embodiment of the guidance element 4, there are at opposite sides of the guidance element 4 two series of guidance channels 18, whereby on each side of the guidance element 4 there are three guidance channels 18 which are arranged in parallel to each other.

DETAILED DESCRIPTION

The guiding recesses 17 have the shape of long-holes which are open at the rim of the first and the second plate 14, 15. The length of the long-hole shape of the guiding recesses 17 is greater than a diameter of a conductor 6. This means that the first and the second plate 14, 15 comprise protrusions 19 that define the guiding recesses 17 and that go beyond the conductors 6 in a lateral direction. This means that in a mounted position of the guidance element 4, two second guidance channels 20 are arranged at the two sides of the elastic element which is defined by the protrusions 19 of the lower and the upper plate 14, 15, the housing 2 and the conductors 6.

The rear end 9 of the housing 2 has the shape of an oval collar 22, whereby four second openings 21 are arranged in the collar at one level providing insertion openings for a retainer element 7 with two parallel arms 23. In the mounted position, the retainer element 7 is inserted at a first side of the collar 22 in two second openings 21, whereby each arm 23 is arranged in a second opening 21. Then the arms 23 are inserted in the second guidance channels 20. The mounted retainer element 7 fixes the guidance element 4 with the housing 2 and pushes the conductors 6 against the elastic element 5. In the mounted position of the retainer element 7 the conductors 6 lie at inner sides of the arms 23 and at the elastic element 5. A conductor 6 comprises an electrical line 24 that is surrounded by an insulating cover 25.

At least one arm 23 of the retainer element 7 comprises at an outer side a projection 26 that latches with a notch that is arranged at an inner face of the collar 22. The two arms 23 of the retainer element 7 are connected by a clip 27 that may have a higher height than the arms 23.

Figure 2:
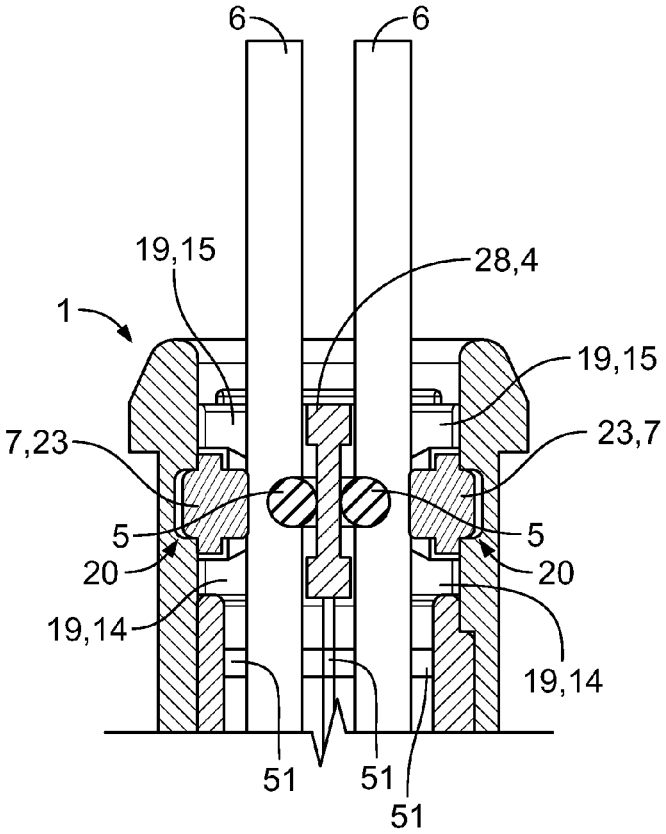
FIG. 2 shows a cross-sectional view of a part of the connector.

FIG. 2 shows a cross-sectional view of a part of the mounted connector 1, whereby the conductors 6 are held by the two arms 23 of the retainer element 7 and pressed against the o-ring 5 which surrounds the connecting element 28 of the guidance element 4. The arms 23 are arranged in the second guidance channels 20 that are defined by the protrusions 19 of the lower and the upper plates 14, 15, the collar 22 of the housing and the connectors 6. As can be seen in FIG. 2, the o-ring 5 is impressed by the conductors 6. This results in a resilient fixing of the conductors 6 by the guidance element 4 and the retainer element 7. Below the guidance element 4 first sealing means 51 are arranged that seal the conductors against the housing 2 and/or against each other.

Figure 3:
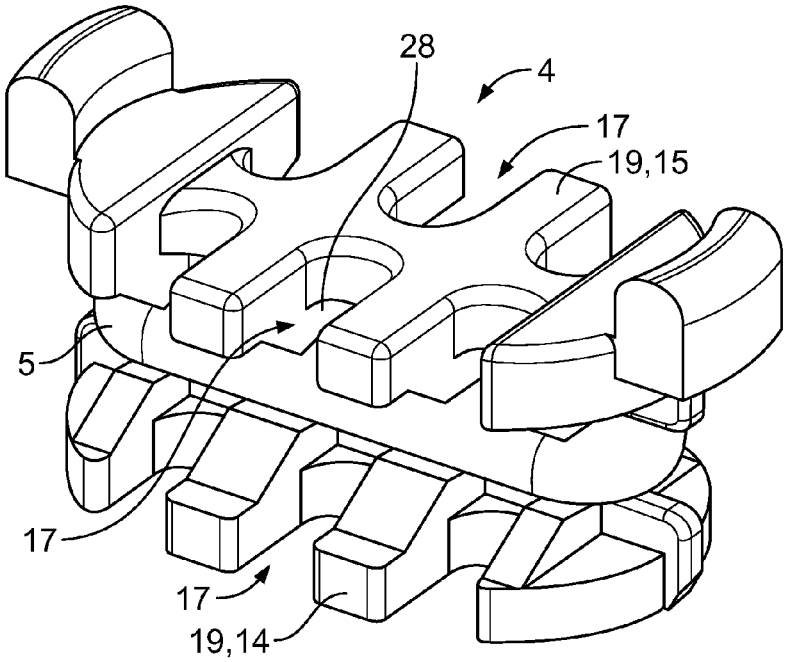
FIG. 3 shows a perspective view of a guidance element with an o-ring.

FIG. 3 shows a perspective view of the guidance element 4 with the o-ring 5 that surrounds the connecting element 28 which has the shape of a longitudinal plate and which connects the upper and the lower plate 15, 14. Instead of one o-ring 5 there might also be more o-rings 5 arranged as elastic elements. Instead of an o-ring also an elastic belt may be arranged.

Figure 4:
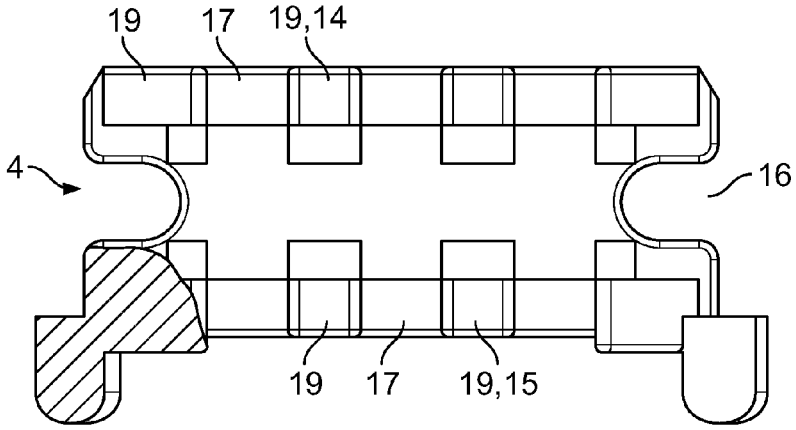
FIG. 4 shows a side view of the guidance element.

FIG. 4 shows a side view of the guidance element 4 without the elastic element 5 in the circular groove 16.

Figure 5:
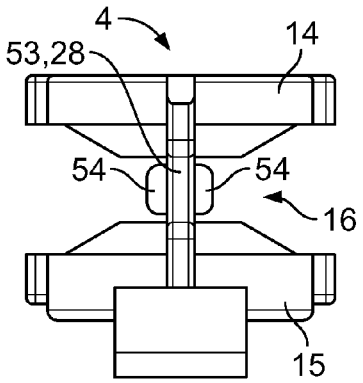
FIG. 5 shows a cross-sectional view of the guidance element.

FIG. 5 shows a cross-sectional view of the guidance element 4 with an elastic element 5 that is part of the connecting element 28. In this embodiment, the connecting element 28 may be made of an elastic material, for example elastic silicone. In a further embodiment, the connecting element 28 may be made of a central stiff plate 53 which is surrounded by an elastic ribbon 54 in one or in two pieces.

Figure 6:
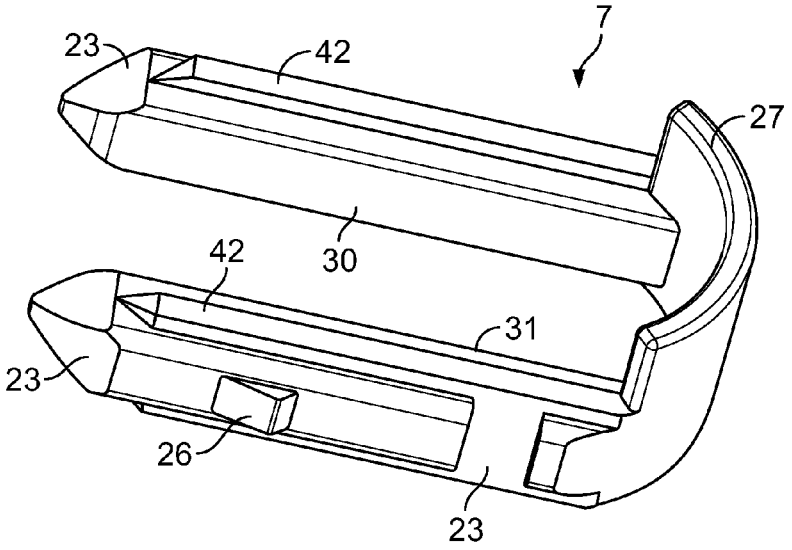
FIG. 6 shows a first perspective view of the retainer element.

FIG. 6 depicts a top view on the retainer element 7 which comprises two arms 23 that are arranged in parallel and connected by the clip 27. Inner sides 31, 32 of the two arms 23 comprise plane faces that are provided for pressing the conductors 6 against the elastic element 5. The two arms 23 comprise on an upper and a lower side a bar 42 that are arranged parallel to the longitudinal direction of the arms 23. The bars 42 are used for guiding the arms in respective grooves of the housing 2.

Figure 7:
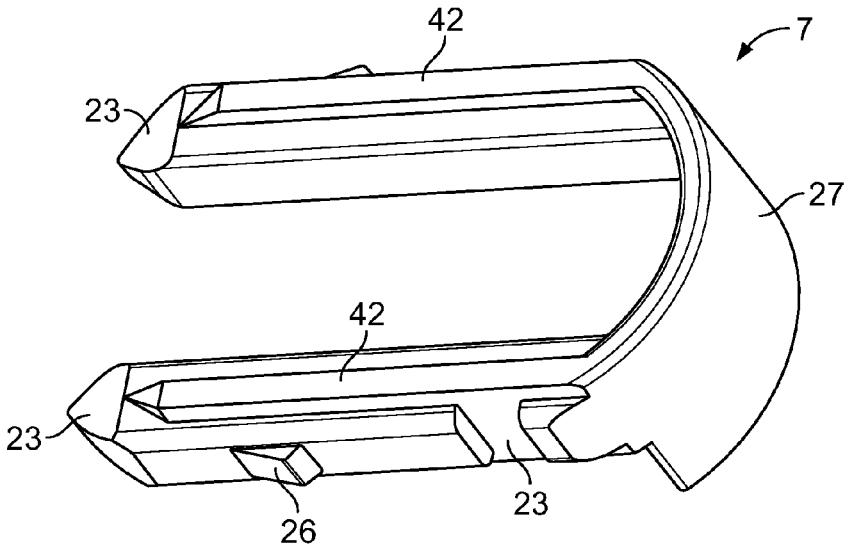
FIG. 7 shows a second perspective view of the retainer element.

FIG. 7 shows a bottom view of the retainer element 7.

Figure 8:
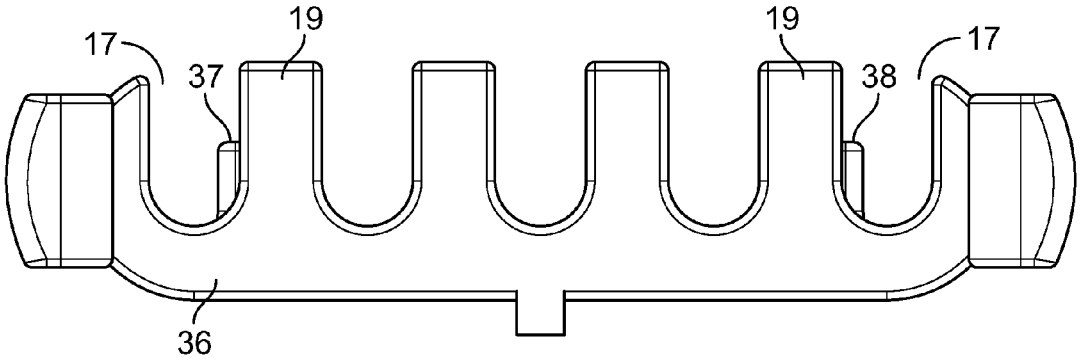
FIG. 8 shows a top view on a second guidance element.

FIG. 8 shows a second guidance element from a top view. The second guidance element 36 comprises only at one side in the lower plate 14 and in the upper plate 15 guiding recesses 17 for providing guiding channels 18 for one row of five conductors 6 that are arranged in parallel.

Figure 9:
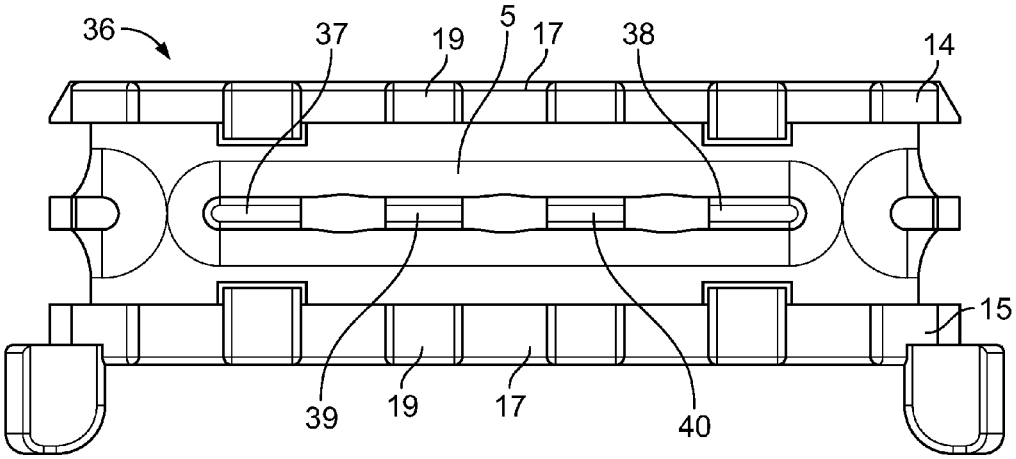
FIG. 9 shows a side view of the second guidance element.

FIG. 9 shows a side view on the second guidance element 36 with the protrusions 19 defining the guidance channels 18 for the conductors 6. The second guidance element 36 provides at two ends two pins 37, 38 which are arranged in the middle between the upper plate 15 and the lower plate 14.

In FIG. 9, additionally the o-ring 5 is disposed and fastened by the first and second pin 37, 38. Depending on the used embodiment, there might also be further pins 39, 40 between the first and the second pin 37, 38. Instead of one o-ring 5 there might also be more o-rings 5 arranged as elastic elements. Instead of an o-ring also an elastic belt may be arranged.

Figure 10:
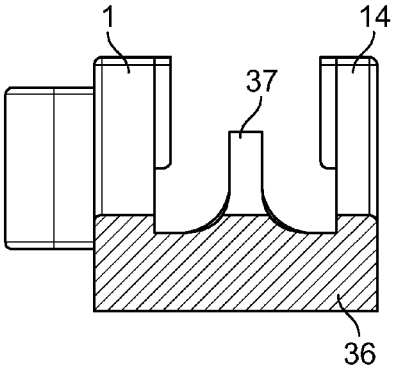
FIG. 10 shows a cross-sectional view of the second guidance element.

FIG. 10 shows a cross-sectional view with a look on the first pin 37 that is arranged in parallel to the lower and the upper plate 14, 15. The second pin 38 is arranged in parallel to the first pin 37.

Figure 11:
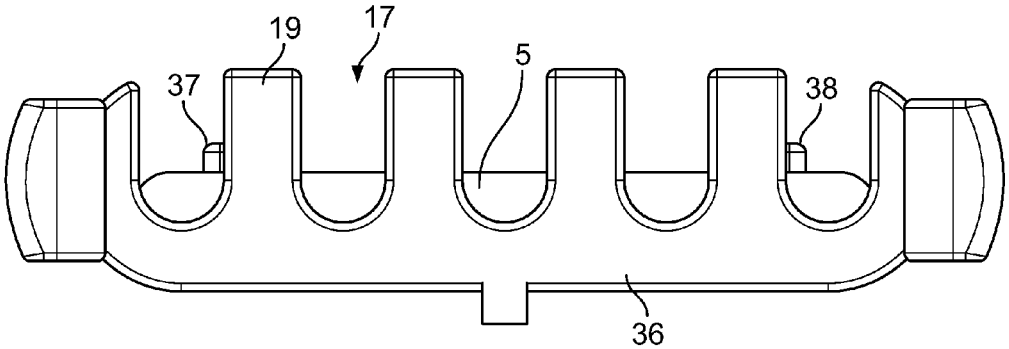
FIG. 11 shows a top view on the second guidance element.

FIG. 11 shows a top view on the second guidance element 36 with a mounted o-ring 5. As can be seen from the figure, the o-ring is arranged in all the guiding recesses 17 of the second guidance element 36 and it is held by the first and second pin 37, 38 at opposite ends of the second guidance element 36.

The o-ring may be made of any type of elastic material, for example elastomer, in the example silicon elastomer.

Figure 12:
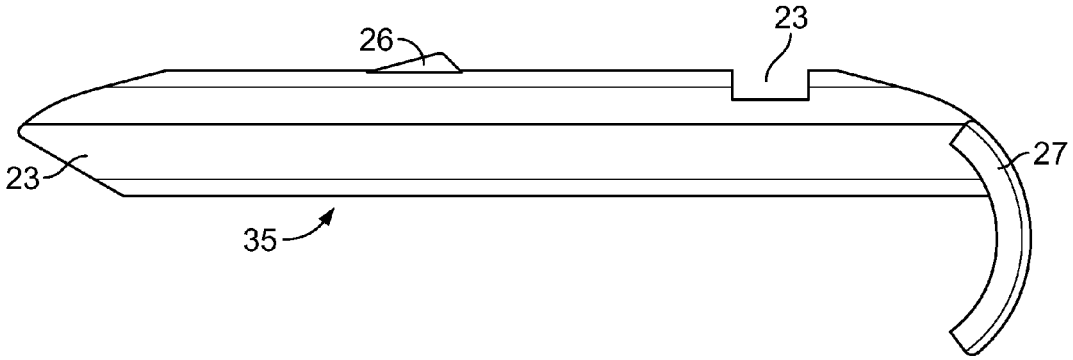
FIG. 12 shows a top view on a second retainer element.

FIG. 12 depicts a second retainer element 35 that may be used with a second guidance element 36 as shown in FIGS. 8-11. The second retainer element 35 comprises only one arm 23 with a clip 27. The second retainer element 35 comprises at an outer side of the arm 23 a projection 26 for latching with a notch of the collar 22.

Figure 13:
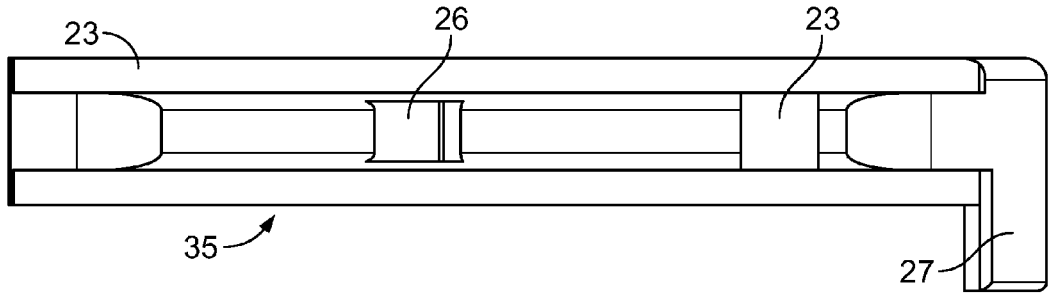
FIG. 13 shows a side view of the second retainer element.

FIG. 13 shows a side view of the second retainer element 35, whereby the clip 27 extends from the arm 23 a predetermined distance. Therefore, the clip 27 may be used for handling the second retainer element 35. In the mounted position, the second retainer element 35 is introduced in the second guidance channel 20 that is defined by the second guidance element 36 and a wall of the collar 22.

Figure 14:
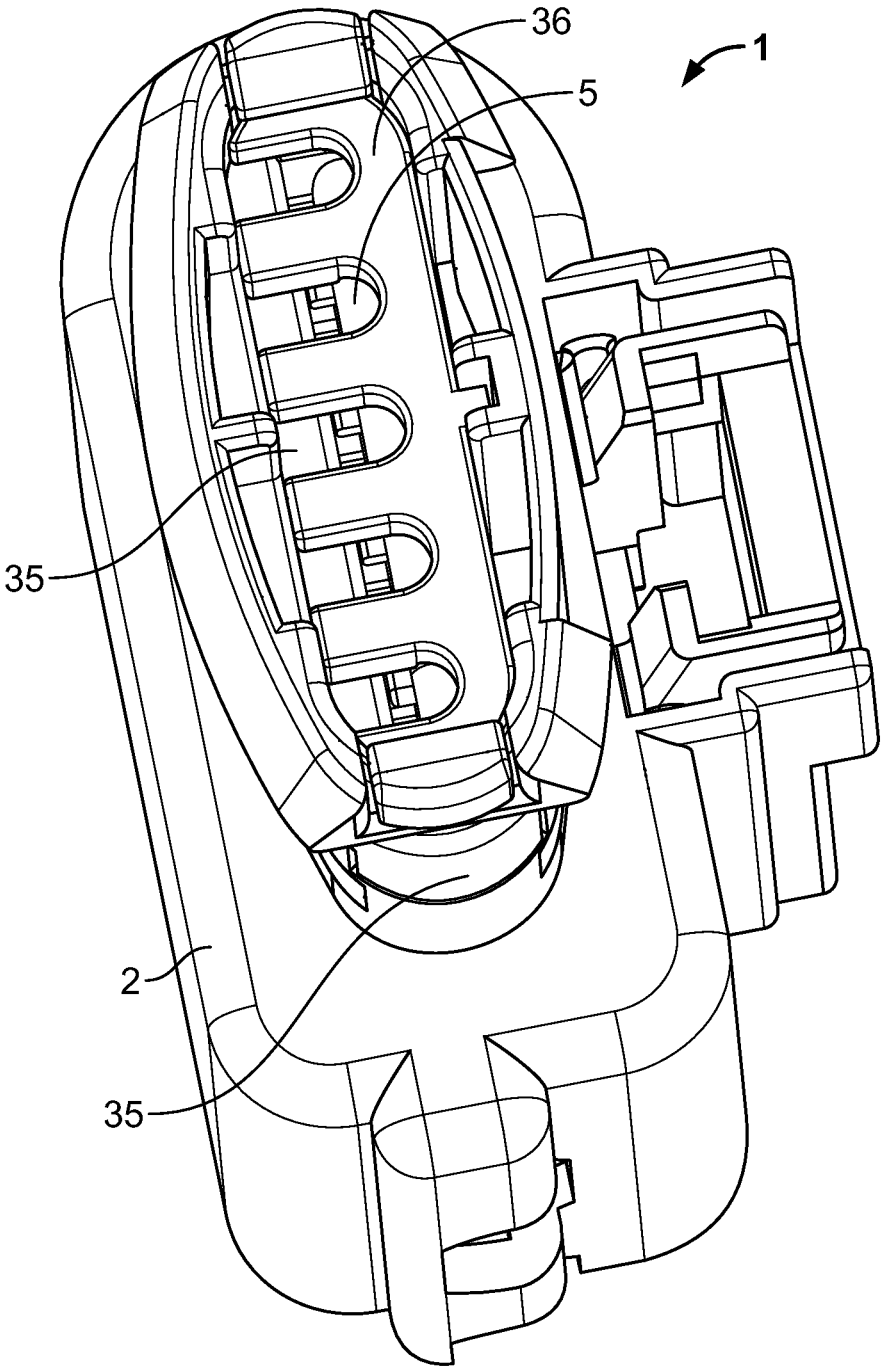
FIG. 14 shows a second connector.

FIG. 14 shows a further embodiment of a connector 1 with a second retainer element 35 as shown in FIGS. 12 and 13 and with a second guidance element 36 and an elastic element 5 as shown in FIGS. 9,10,11.

In a further embodiment, there are sealing means 51, for example a sealing ring that circumvents the conductors 6 and is arranged between the housing 2 and the conductors 6. In a further embodiment, the connectors 6 may comprise second sealing means that circumvents the conductors 6 and that seals the conductors 6 against each other and/against the housing 2.

The elastic element 5 therefore has not the function of sealing the conductors 6 and/or the housing 2 against the intrusion of water or dust. The elastic element 5 has the task to fasten resiliently the conductors 6 to prevent transmission of movement and/or forces via the conductors 6 to the terminals 3.

The invention claimed is:

1. Connector with a housing, with terminals, with conductors that are connected with the terminals, with a guidance element that is arranged in the housing and that guides the conductors in the housing, with an elastic element that is arranged between the conductors and the guidance element, with a retainer element that forces the conductors against the elastic element, wherein the elastic element is an elastic O-ring which surrounds the guidance element, whereby each conductor contacts the O-ring with one section.

2. Connector of claim 1, wherein the elastic element is part of the guidance element.

3. Connector of claim 1, wherein the guidance element comprises recesses in which the conductors are arranged.

4. Connector of claim 3, wherein the guidance element has two rows of recesses at opposite sides, whereby at the two opposite sides the conductors are arranged and guided in the recesses.

5. Connector of claim 1, wherein the O-ring is arranged at one side of the guidance element, whereby at least one conductor is in contact with two sections of the O-ring.

6. Connector of claim 5, wherein the guidance element comprises at two opposite ends two protruding parts, whereby the O-ring is fixed on the two protruding parts.

7. Connector of claim 1, wherein the conductors comprise sealing elements that are arranged between the conductors and the housing to seal against dust and/or water.

8. Connector of claim 1, wherein the retainer element comprises two arms that are arranged at two sides of the guidance element.

9. Connector of claim 1, wherein the retainer element comprises one arm that is arranged at one side of the guidance element.

10. Connector of claim 1, wherein snapping means are arranged that link the retainer element with the housing.

11. Connector with a housing, with terminals, with conductors that are connected with the terminals, with a guidance element that is arranged in the housing and that guides the conductors in the housing, with an elastic O-ring that is arranged between the conductors and the guidance element and at one side of the guidance element, wherein at least one conductor is in contact with two sections of the O-ring, and a retainer element that forces the conductors against the elastic O-ring, and wherein the guidance element comprises at two opposite ends two protruding parts, whereby the O-ring is fixed on the two protruding parts.

12. Connector of claim 11, wherein the elastic O-ring is part of the guidance element.

13. Connector of claim 11, wherein the guidance element comprises recesses in which the conductors are arranged.

14. Connector of claim 13, wherein the guidance element has two rows of recesses at opposite sides, whereby at the two opposite sides the conductors are arranged and guided in the recesses.

15. Connector of claim 11, wherein the conductors comprise sealing elements that are arranged between the conductors and the housing to seal against dust and/or water.

16. Connector of claim 11, wherein the retainer element comprises two arms that are arranged at two sides of the guidance element.

17. Connector of claim 11, wherein the retainer element comprises one arm that is arranged at one side of the guidance element.

18. Connector of claim 11, wherein snapping means are arranged that link the retainer element with the housing.

* * * * *